US007898346B2

(12) United States Patent
Kobayashi et al.

(10) Patent No.: US 7,898,346 B2
(45) Date of Patent: Mar. 1, 2011

(54) POWER SUPPLY APPARATUS AND HIGH-FREQUENCY CIRCUIT SYSTEM

(75) Inventors: Junichi Kobayashi, Sagamihara (JP); Yukihira Nakazato, Sangamihara (JP)

(73) Assignee: Netcomsec Co., Ltd., Tokyo (JP)

( * ) Notice: Subject to any disclaimer, the term of this patent is extended or adjusted under 35 U.S.C. 154(b) by 414 days.

(21) Appl. No.: 12/182,527

(22) Filed: Jul. 30, 2008

(65) Prior Publication Data

US 2009/0033228 A1 Feb. 5, 2009

(30) Foreign Application Priority Data

Jul. 31, 2007 (JP) ..... 2007-198768

(51) Int. Cl.
*H03B 9/08* (2006.01)
*H03F 3/58* (2006.01)

(52) U.S. Cl. ..... 331/82; 331/79; 331/83; 330/43; 330/44; 330/45

(58) Field of Classification Search ..... 331/82, 331/79, 83, 7, 8, 6; 330/43, 44, 45, 4.6, 4.7; 315/39.3, 39, 3.5
See application file for complete search history.

(56) References Cited

U.S. PATENT DOCUMENTS 3,596,209 A * 7/1971 Picard ..... 330/43
4,323,853 A * 4/1982 Kurokawa ..... 330/43
2007/0176689 A1* 8/2007 Kobayashi et al. ..... 331/7

FOREIGN PATENT DOCUMENTS

JP 08-111183 A 4/1996

* cited by examiner

*Primary Examiner* — Tuyet Thi Vo
(74) *Attorney, Agent, or Firm* — Sughrue Mion, PLLC

(57) ABSTRACT

A power supply apparatus for a traveling-wave tube includes an electrical discharge switch and a first resistor that are serially connected, and that are connected between a cathode electrode and a first collector electrode; N (N denotes a positive integer) arresters that are serially connected, and that are inserted between a ground potential and a connection node of the electrical discharge switch and the first resistor; N second resistors that are inserted between the N arresters and a second collector electrode to an Nth collector electrode and a ground potential, respectively; and an electrical discharge control circuit that turns off the electrical discharge switch at a time of normal operation of the power supply apparatus and turns on the electrical discharge switch when stopping operation of the power supply apparatus.

12 Claims, 5 Drawing Sheets

POWER SUPPLY APPARATUS AND HIGH-FREQUENCY CIRCUIT SYSTEM

This application is based upon and claims the benefit of priority from Japanese patent application No. 2007-198768, filed on Jul. 31, 2007, the disclosure of which is incorporated herein in its entirety by reference.

BACKGROUND OF THE INVENTION

1. Field of Invention

The present invention relates to a power supply apparatus that is suitable for supplying a predetermined direct-current (DC) voltage to each electrode of a traveling-wave tube, and a high-frequency circuit system which incorporates the power supply apparatus.

2. Description of the Related Art

Traveling-wave tubes or klystrons or the like are electron tubes for amplifying or oscillating a high-frequency signal based on an interaction between an electron beam emitted from an electron gun and a high-frequency circuit. As shown in FIG. 1, a traveling-wave tube, for example, includes electron gun 6 that emits an electron beam, helix 2 serving as a high-frequency circuit for causing interaction between a high frequency signal (microwave) and an electron beam emitted from the electron gun, first collector electrode 3 and second collector electrode 4 for trapping the electron beam output from helix 2, and anode electrode 5 for drawing electrons from electron gun 6 and guiding the electron beam emitted from electron gun 6 into spiral-shaped helix 2.

Electron gun 6 comprises cathode electrode 7 that emits thermal electrons, heater 8 that applies thermal energy to cathode electrode 7 to cause emission of thermal electrons therefrom, and Wehnelt electrode 9 for focusing electrons emitted from cathode electrode 7 to form an electron beam.

An electron beam that is emitted from electron gun 6 is accelerated by the potential difference between cathode electrode 7 and helix 2 and introduced into helix 2. The electron beam travels through the inside of helix 2 while interacting with a high frequency signal that is input from one end of helix 2. After passing through the inside of helix 2, the electron beam is trapped by first collector electrode 3 and second collector electrode 4. At this time, a high frequency signal that has been amplified by an interaction with the electron beam is output from the other end of helix 2.

Although FIG. 1 shows a configuration example in which traveling-wave tube 1 comprises two collector electrodes (first collector electrode 3 and second collector electrode 4), a configuration in which traveling-wave tube 1 comprises only one collector electrode or comprises three or more collector electrodes is also available.

As shown in FIG. 1, a helix voltage (HX) which is a DC voltage that is negative with respect to a potential (HEL) of helix 2 is supplied to cathode electrode 7, a first collector voltage (COL1) which is a DC voltage that is positive with respect to a potential (HK) of cathode electrode 7 is supplied to first collector electrode 3, and a second collector voltage (COL2) which is a DC voltage that is positive with respect to the potential (HK) of cathode electrode 7 is supplied to second collector electrode 4. Further, an anode voltage (A) that is a DC voltage that is positive with respect to the potential (HK) of cathode electrode 7 is supplied to anode electrode 5, and a heater voltage (H) that is a DC voltage that is negative with respect to the potential (HK) of cathode electrode 7 is supplied to heater 8. Helix 2 is normally connected to the case of traveling-wave tube 1 and is grounded.

The helix voltage (HK), first collector voltage (COL1), and second collector voltage (COL2) are generated using transformer 31, inverter 32 that is connected to a primary winding of transformer 31 and that converts a DC voltage supplied from outside into an alternating-current (AC) voltage, rectifying circuits 33, 34, and 35 that convert an AC voltage output from the secondary winding of transformer 31 into a DC voltage, and rectifier capacitors C11 to C13 that smooth a DC voltage that is output from rectifying circuits 33 to 35.

The anode voltage (A) and Wehnelt voltage are also generated using the inverter, transformer, rectifying circuits and rectifier capacitors in the same manner as described above. The heater voltage (H) is normally generated using the inverter, the transformer, and the rectifying circuits, without using the rectifier capacitors.

The traveling-wave tube shown in FIG. 1 is capable of controlling the amount of electrons emitted from cathode electrode 7 by the anode voltage (A). Therefore, the electric power of a high-frequency signal output from traveling-wave tube 1 can be controlled by the anode voltage (A). For example, even while a high-frequency signal of a constant electric power is being input to traveling-wave tube 1, traveling-wave tube 1 can output a pulsed high-frequency signal by applying a pulsed anode voltage (A) to anode electrode 7. Similar control is also possible using the Wehnelt voltage that is applied to Wehnelt electrode 9 of electron gun 6.

Power supply apparatus 30 shown in FIG. 1 comprises anode switch 36 that supplies or stops the supply of the anode voltage (A) to anode electrode 7, and anode switch control circuit 37 that controls the on/off operations of anode switch 36. Power supply apparatus 30 represents a configuration example in which the pulsed anode voltage (A) can be applied to anode electrode 7.

However, in a high-frequency circuit system as shown in FIG. 1, to prevent damage caused by an excessive current flowing to helix 2 of traveling-wave tube 1 when the power is turned on or turned off, it is necessary to control the order in which the supply of various power supply voltages are turned on and off.

For example, when the power is turned on, first, the heater voltage (H) is supplied to pre-heat heater 8 of traveling-wave tube 1, next, inverter 32 is actuated to supply the helix voltage (HK), the first collector voltage (COL1), and the second collector voltage (COL2), and finally the anode voltage (A) is supplied. In contrast, when turning off the power, first, the supply of the anode voltage (A) is turned off (making the anode voltage (A) equal with the potential (HK) of the cathode electrode), next, the operation of inverter 32 is stopped to turn off the supply of the helix voltage (HK), the first collector voltage (COL1), and the second collector voltage (COL2), and finally the supply of the heater voltage (H) is stopped. The aforementioned anode switch 36 can also be used to supply or to cutoff the supply (stop supply) of the anode voltage (A) when the power is turned on or when the power is turned off. The sequence when the power is turned on or is turned off in this kind of traveling-wave tube 1 is also described, for example, in Japanese Patent Laid-Open No. 8-111183.

In this connection, when supplying a Wehnelt voltage to Wehnelt electrode 9 of electron gun 6, it is sufficient that the Wehnelt voltage be supplied last when the power is turned on, and that the supply of the Wehnelt voltage be stopped first when the power is turned off.

In the above described sequence at the time of stopping the power supply to the traveling-wave tube, when the supply of the anode voltage (A) or Wehnelt voltage is stopped first, since the emission of electrons from cathode electrode 7 stops, the span between each electrode of traveling-wave tube 1 enters a substantially open state. Accordingly, when operation of inverter 32 is stopped to stop supply of the helix voltage (HK), the first collector voltage (COL1), and the second collector voltage (COL2), the helix voltage (HK), the first collector voltage (COL1) and the second collector voltage (COL2) are maintained as they are, since there is no electrical discharge path for electric charges that are accumulated in the rectifier capacitors C11 to C13. In general, since a DC voltage (power supply voltage) supplied to each electrode of traveling-wave tube 1 is between several KV and several tens of KV, when testing or performing maintenance work on traveling-wave tube 1, after stopping the power supply it is necessary to adequately decrease these high voltages using some kind of electrical discharge means.

Since a configuration that has a low current supply capacity is used for a power supply circuit that generates an anode voltage (A) or Wehnelt voltage, even if the anode voltage (A) or Wehnelt voltage remains, the remaining voltage does not constitute a problem. Normally, since a load resistor for stabilizing an output voltage is provided between the output terminals of a power supply circuit that generates the anode voltage (A) or the Wehnelt voltage, when the supply of the anode voltage or Wehnelt voltage stops, an electric charge that is accumulated in a rectifier capacitor is discharged through the load resistor.

In contrast, because a configuration that has a large current supply capacity is used in a power supply circuit that generates a helix voltage or a first collector voltage and second collector voltage, for example, discharge bleeder resistor Rb is provided for each of rectifying circuits 33 to 35 shown in FIG. 1, and electric charges that accumulate in rectifier capacitors C11 to C13 are discharged through discharge bleeder resistors Rb. For discharge bleeder resistors Rb, a comparatively large value (approximately several MΩ) is used for decreasing current that flows at the time of normal operation of power supply apparatus 30.

However, in a configuration that discharges electric charges accumulated in rectifier capacitors C11 to C13 using discharge bleeder resistors Rb, since electric charges are discharged depending on a time constant that is determined based on the values of rectifier capacitors C11 to C13 and values of discharge bleeder resistors Rb, as shown in FIG. 2, there is the problem that time is required until the helix voltage (HK), the first collector voltage (COL1), and the second collector voltage (COL2) decrease sufficiently (approach the potential of the helix (HEL: ground potential)).

As a method for reducing the discharge time of a rectifier capacitor, a method can be considered in which current decreasing resistor Rg is connected to an output terminal of the helix voltage (HK), and the output terminal of the helix voltage (HK) is short circuited with a ground potential through current decreasing resistor Rg using ground rod 38 (see FIG. 1). Alternatively, a method can be considered in which an output terminal of the helix voltage (HK) or a collector voltage is short circuited with a ground potential when operation of the power supply apparatus is stopped by using a high-voltage vacuum relay.

However, since work to short circuit an output terminal of the helix voltage (HK) with ground potential using ground rod 38 involves directly touching a high voltage location, there is a problem that safety decreases when performing such work. On the other hand, although safety when performing work can be ensured in a configuration using a high-voltage vacuum relay, because the cost of a high-voltage vacuum relay is high, the overall cost of the high-frequency circuit system comprising the traveling-wave tube and the power supply apparatus increases.

SUMMARY OF THE INVENTION

It is an object of the present invention to provide a power supply apparatus which, with a low cost and simple configuration, is capable of discharging in a shorter time than heretofore an electric charge that is accumulated in a rectifier capacitor when the power supply is stopped while ensuring safety when performing work after stopping the power supply, and a high-frequency circuit system which incorporates such a power supply apparatus.

To achieve the above object, a power supply apparatus according to the present invention is a power supply apparatus that, when N is assumed to be a positive integer, supplies a predetermined DC voltage to an anode electrode, a cathode electrode and a first collector electrode to an Nth collector electrode that are of an electron tube, the power supply apparatus comprising:

an electrical discharge switch and a first resistor that are serially connected, and that are connected between the cathode electrode and the first collector electrode;

N arresters that are serially connected, and that are inserted between a ground potential and a connection node of the electrical discharge switch and the first resistor;

N second resistors that are inserted between the N arresters and a second collector electrode to the Nth collector electrode and a ground potential, respectively; and an electrical discharge control circuit that turns off the electrical discharge switch at a time of normal operation of the power supply apparatus to put the electrical discharge switch in an open state, and turns on the electrical discharge switch when stopping operation of the power supply apparatus to put the electrical discharge switch in a short-circuit state.

A power supply apparatus according to another aspect of the present invention is a power supply apparatus that, when N is assumed to be a positive integer, supplies a predetermined DC voltage to an anode electrode, a cathode electrode and a first collector electrode to an Nth collector electrode that are of an electron tube, the power supply apparatus comprising:

an electrical discharge switch and a first resistor that are serially connected, and that are connected between the cathode electrode and the first collector electrode;

N arresters and N second resistors that are serially connected, and that are inserted between a connection node of the first resistor and the electrical discharge switch, and a second collector electrode to an Nth collector electrode and a ground potential, respectively; and an electrical discharge control circuit that turns off the electrical discharge switch at a time of normal operation of the power supply apparatus to put the electrical discharge switch in an open state, and turns on the electrical discharge switch when stopping operation of the power supply apparatus to put the electrical discharge switch in a short-circuit state.

A power supply apparatus according to a further aspect of the present invention supplies a predetermined DC voltage to an anode electrode, a cathode electrode and a collector electrode that are of an electron tube, the power supply apparatus comprising:

an electrical discharge switch and a first resistor that are serially connected, and that are connected between the cathode electrode and the collector electrode;

an arrester and a second resistor that are serially connected, and that are inserted between a connection node of the electrical discharge switch and the first resistor, and a ground potential; and an electrical discharge control circuit that turns off the electrical discharge switch at a time of normal operation of the power supply apparatus to put the electrical discharge switch in an open state, and turns on the electrical discharge switch when stopping operation of the power supply apparatus to put the electrical discharge switch in a short-circuit state.

A high-frequency circuit system according to the present invention comprises:

a power supply apparatus that is described above; and a traveling-wave tube to which an anode voltage, a cathode voltage, a collector voltage and a helix voltage that are a predetermined DC voltage, are supplied from the power supply apparatus.

The above and other objects, features, and advantages of the present invention will become apparent from the following description with reference to the accompanying drawings, which illustrate examples of the present invention.

DETAILED DESCRIPTION OF THE PREFERRED EMBODIMENT

Figure 1:
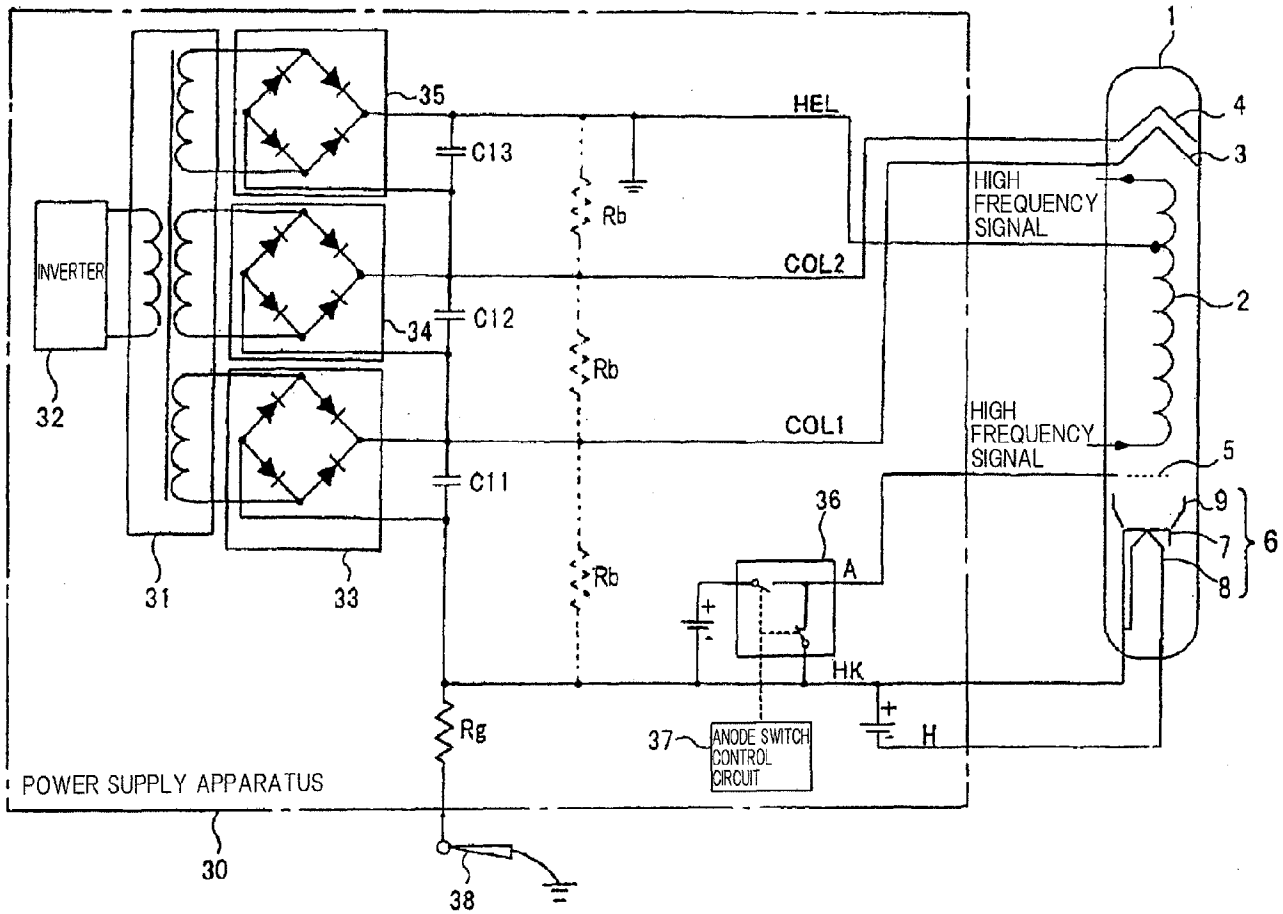
FIG. 1 is a block diagram that illustrates a configuration example of a conventional high-frequency circuit system.
Figure 2:
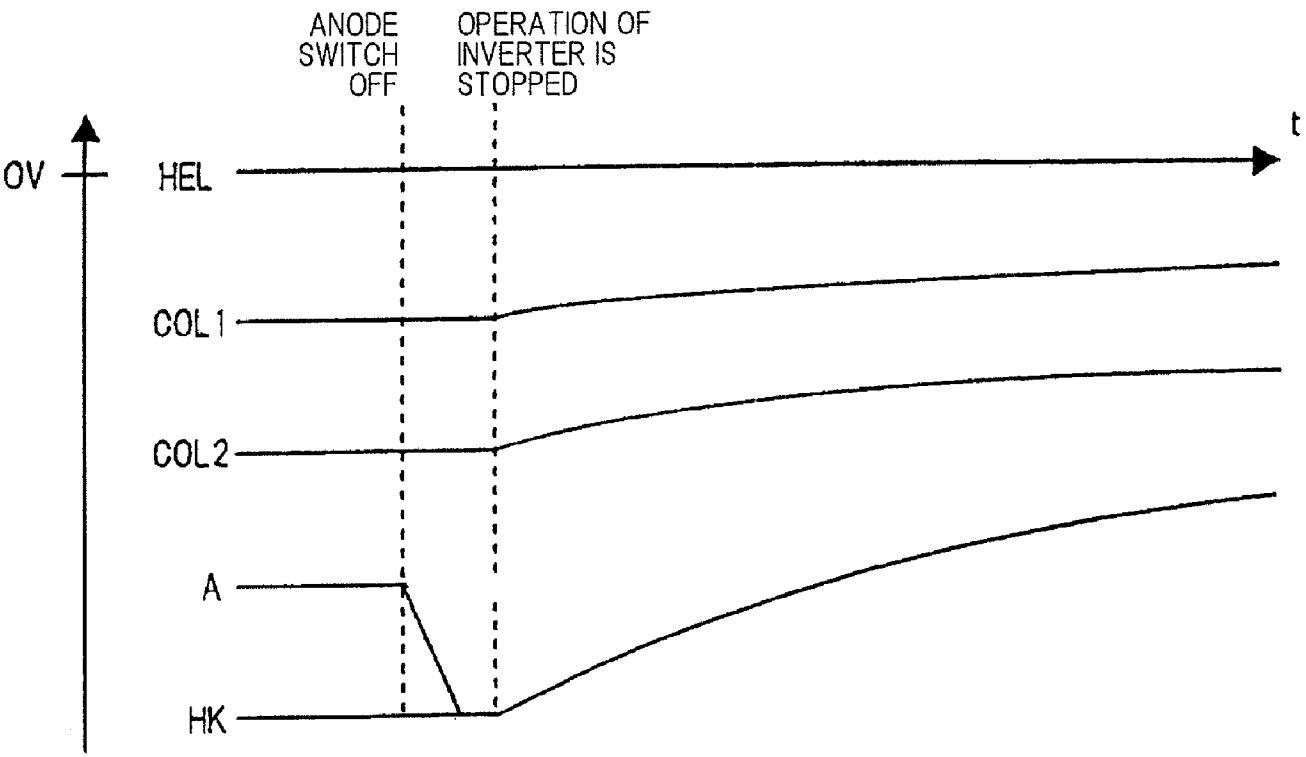
FIG. 2 is a timing chart that illustrates the manner of change in each power supply voltage when stopping operation of a power supply apparatus illustrated in FIG. 1.

Next, the present invention is described referring to the drawings.

First Exemplary Embodiment

Figure 3:
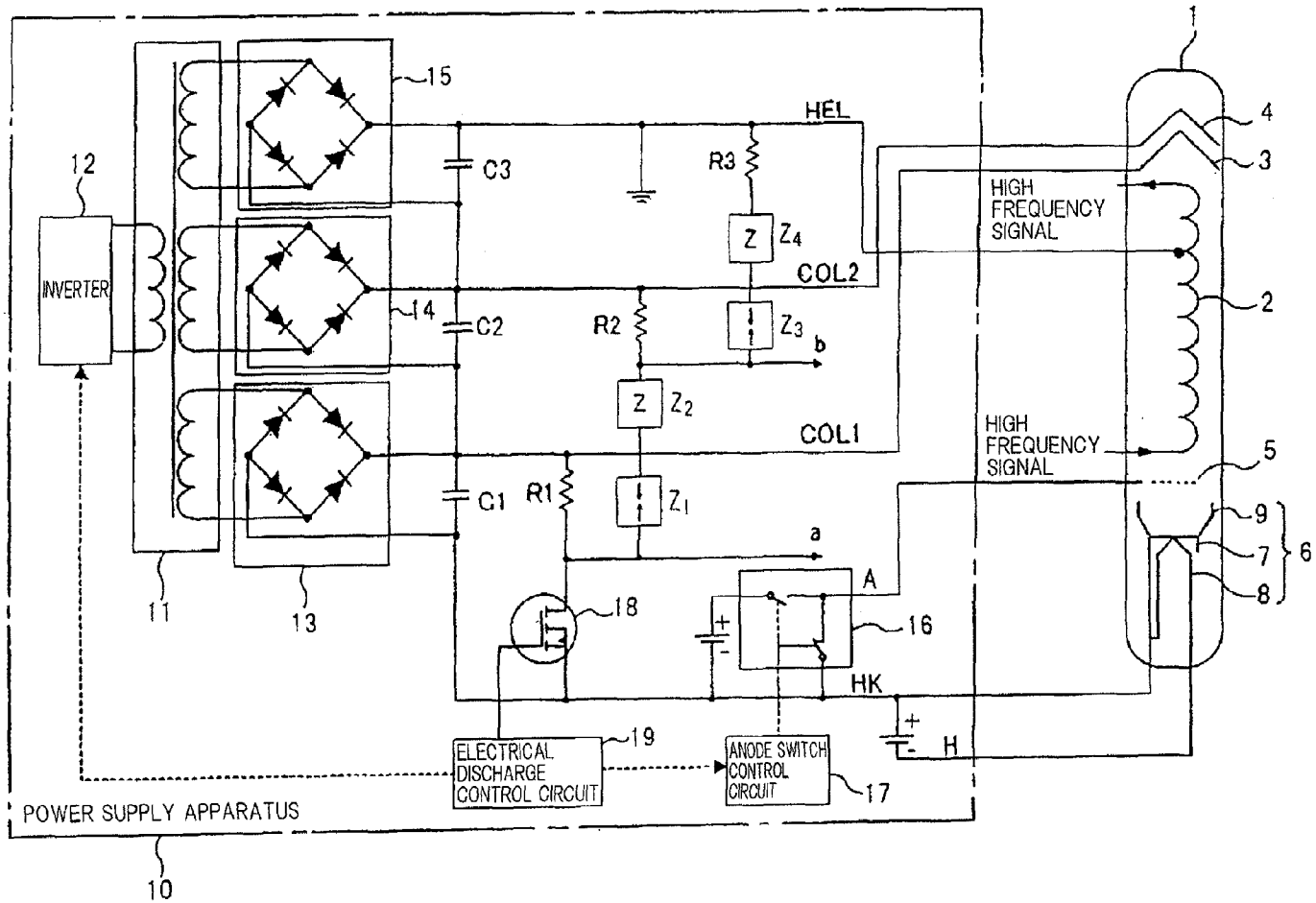
FIG. 3 is a block diagram that illustrates the configuration of a high-frequency circuit system according to a first exemplary embodiment.

FIG. 3 is a block diagram that illustrates the configuration of a high-frequency circuit system according to a first exemplary embodiment.

As illustrated in FIG. 3, a high-frequency circuit system according to the first exemplary embodiment includes traveling-wave tube 1 and power supply apparatus 10 that supplies a predetermined DC voltage (power supply voltage) to each electrode of traveling-wave tube 1.

Traveling-wave tube 1 shown in FIG. 3 comprises two collector electrodes (first collector electrode 3 and second collector electrode 4), similarly to traveling-wave tube 1 shown in FIG. 1. The remaining configuration is the same as that of traveling-wave tube 1 shown in FIG. 1, and therefore will not be described in detail below. Power supply apparatus 10 shown in FIG. 3 is an example of a configuration that supplies two kinds of collector voltages (first collector voltage (COL1) and second collector voltage (COL2)) to traveling-wave tube 1 comprising two collector electrodes (first collector electrode 3 and second collector electrode 4).

As shown in FIG. 3, the power supply apparatus according to the first exemplary embodiment comprises: transformer 11; inverter 12 that supplies an AC voltage to a primary winding of transformer 11; rectifying circuits 13 to 15 that generate a helix voltage (HK), a first collector voltage (COL1), and a second collector voltage (COL2) that are supplied to traveling-wave tube 1; electrical discharge switch 18 and resistor R1 that are serially connected and that are connected between cathode electrode 7 and first collector electrode 3; first arrester Z1, first varistor Z2 and resistor R2 that are serially connected and that are connected between connection node a of electrical discharge switch 18 and resistor R1, and second collector electrode 4; second arrester Z3, second varistor Z4, and resistor R3 that are serially connected and that connect between connection node b of first varistor Z2 and resistor R2, and helix 2 (ground potential); anode switch 16 that supplies or does not supply an anode voltage (A) to anode electrode 7; anode switch control circuit 17 that controls on/off operations of anode switch 16; and electrical discharge control circuit 19 that turns off electrical discharge switch 18 at a time of normal operation of power supply apparatus 10 to put electrical discharge switch 18 in an open state and turns on electrical discharge switch 18 when stopping operation of power supply apparatus 10 to put electrical discharge switch 18 in a short-circuit state. The required power supply voltage is supplied by a voltage source, not shown, to anode switch control circuit 17 and electrical discharge control circuit 19.

In FIG. 3, although an inverter, a transformer, rectifying circuits and rectifier capacitors and the like for generating an anode voltage (A), a Wehnelt voltage, and a heater voltage (H) are not shown, a transformer or inverter used for generating these voltages may be common in which the inverter or transformer is used to generate the aforementioned helix voltage (HK), first collector voltage (COL1) and second collector voltage (COL2), or may be comprised independently.

A MOSFET or the like that is capable of operating at a high voltage is, for example, used for electrical discharge switch 18.

Resistors R1 to R3 are provided for consuming electric charges that are accumulated in rectifier capacitors C1 to C3, and a value (approximately several tens Ω to several hundred Ω) that is smaller than that of the aforementioned discharge bleeder resistor Rb is used therefor.

A discharge gap-type arrester is used, for example, for first arrester Z1 and second arrester Z3. A discharge gap-type arrester is in an open state when a voltage that is lower than a predetermined discharge starting voltage (approximately several KV to several tens of KV) is being applied between two terminals, and starts electric discharge and enters a short-circuit state when a voltage equal to or greater than the discharge starting voltage is being applied. The discharge gap-type arrester has follow current characteristics such that once the arrester starts an electric discharge, the electric discharge continues even if the applied voltage is low. An arrester that starts an electric discharge stops the electric discharge and returns to an open state at a time when the flowing current becomes equal to or less than a predetermined value (a current at which electric discharge cannot be maintained).

First varistor Z2 and second varistor Z4 have characteristics whereby an open state is entered when a voltage lower than a predetermined voltage (approximately several V to several tens of V) is being applied between two terminals. First varistor Z2 and second varistor Z4 have characteristics whereby a short-circuit state is entered when a voltage equal to or greater than the predetermined voltage is being applied between two terminals. However, first varistor Z2 and second varistor Z4 do not have follow current characteristics such as those of first arrester Z1 or second arrester Z3.

As described later, according to the power supply apparatus of the present exemplary embodiment, only electrical discharge switch 18, first arrester Z1, and second arrester Z3 contribute to an operation to discharge electric charges that are accumulated by rectifier capacitors C1 to C3, and an electric charge accumulated in each of rectifier capacitors C1 to C3 can be discharged even without first varistor Z2 and second varistor Z4 that are shown in FIG. 3.

In this case, once first arrester Z1 or second arrester Z3 starts an electric discharge, since a short-circuit state is maintained until the flowing current becomes equal to or less than the above described predetermined value, time is required until the relevant arrester returns to an open state. Therefore, when operation of power supply apparatus 10 is stopped and the power is then turned on again, if first arrester Z1 or second arrester Z3 is maintaining a short-circuit state, there is a risk that an excessive current will flow through first arrester Z1 or second arrester Z3 and damage power supply apparatus 10.

Thus, according to power supply apparatus 10 of the present exemplary embodiment, respective varistors are connected in series with each arrester, and at a stage where a potential difference of approximately several V to several tens of V remains between the two ends of the arrester and varistor, the varistor is made to enter an open state to cutoff current (follow current) flowing to the arrester, and the arrester is returned to an open state. A voltage at which the varistor enters an open state is set to a value at which a potential difference, that remains between the ends of the arrester and varistor at a time of maintenance work or testing of traveling-wave tube 1, does not constitute a safety problem.

By cutting off current (follow current) flowing to an arrester using a varistor in this manner, when stopping operation of a power supply apparatus it is possible to return the arrester more quickly from a short-circuit state to an open state. Accordingly, the occurrence of accidents that damage power supply apparatus 10 can be suppressed.

For a configuration in which traveling-wave tube 1 comprises only one collector electrode, it is sufficient that traveling-wave tube 1 comprises two sets of the rectifying circuits and rectifier capacitors shown in FIG. 3. For a configuration in which a traveling-wave tube comprises three or more collector electrodes, it is sufficient that the traveling-wave tube comprises a number of the rectifying circuits and rectifier capacitors shown in FIG. 3 that is consistent with the number of collector electrodes. More specifically, in a case where traveling-wave tube 1 comprises N (N denotes a positive integer) collector electrodes, it is sufficient that traveling-wave tube 1 comprises N+1 sets of the rectifying circuits and rectifier capacitors shown in FIG. 3.

According to power supply apparatus 10 of the present exemplary embodiment, in a case where traveling-wave tube 1 comprises only a single collector electrode, it is sufficient that electrical discharge switch 18 and a first resistor (corresponding to resistor R1 shown in FIG. 3) that are connected in series, are connected between cathode electrode 7 and the collector electrode. Further, it is sufficient that an arrester and a second resistor that are connected in series, are connected between a ground potential and the connection node of the electrical discharge switch and the first resistor. In this case, when using a varistor, it is sufficient to connect the varistor between the arrester and the second resistor.

Furthermore, when the traveling-wave tube comprises three or more collector electrodes, it is sufficient that: electrical discharge switch 18 and a first resistor (corresponding to resistor R1 shown in FIG. 3) that are connected in series, are connected between cathode electrode 7 and first collector electrode 3; N (N denotes a positive integer) arresters that are connected in series and that are equal in quantity to N collector electrodes are inserted between a ground potential and connection node a of electrical discharge switch 18 and the first resistor; and N second resistors (corresponding to resistors R2 and R3 shown in FIG. 3) are connected between the remaining collector electrodes, other than first collector electrode 3 and a ground potential, and each arrester, respectively. In this case, when using a varistor, it is sufficient to connect the varistor between an arrester and a second resistor, and to insert the varistor so that an arrester of the next stage is connected to a connection node with the second resistor.

Figure 4:
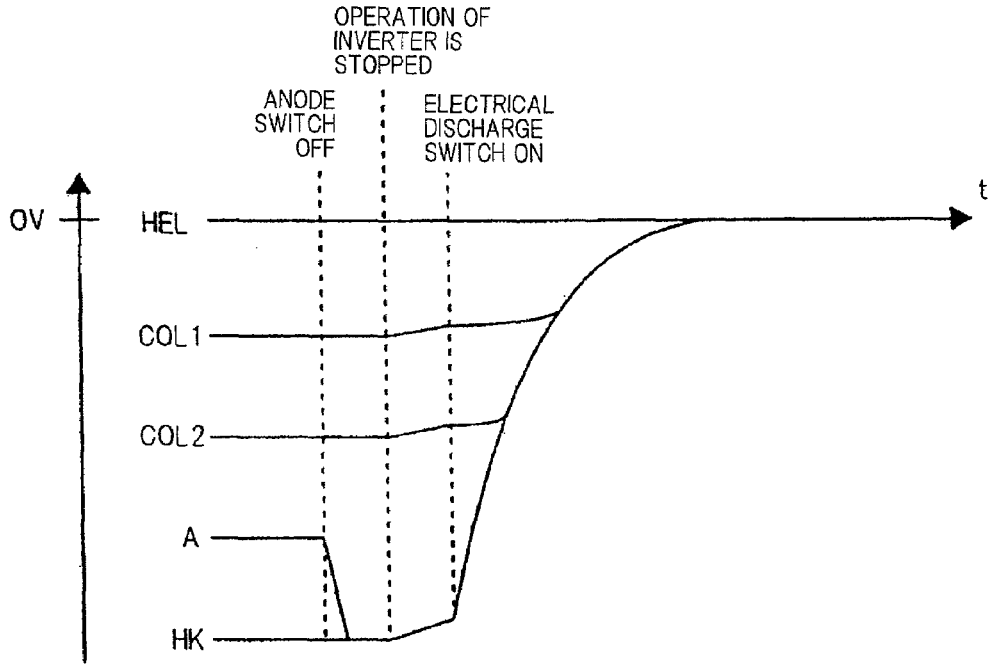
FIG. 4 is a timing chart that illustrates the manner of change in each power supply voltage when stopping operation of a power supply apparatus illustrated in FIG. 3.

Next, operation of the power supply apparatus of the first exemplary embodiment having this configuration is described using FIG. 3 and FIG. 4.

FIG. 4 is a timing chart that illustrates the manner of change in each power supply voltage when stopping operation of the power supply apparatus illustrated in FIG. 3.

Hereunder, as one example, a case is described in which, at a time of normal operation of traveling-wave tube 1, a potential difference between the helix voltage (HK) and the first collector voltage (COL1), a potential difference between the first collector voltage (COL1) and the second collector voltage (COL2), and a potential difference between the second collector voltage (COL2) and the helix potential (HEL: ground potential) are each 1 KV, and a discharge starting voltage of first arrester Z1 and second arrester Z3 is 1.5 KV.

First, during normal operation of traveling-wave tube 1, electrical discharge control circuit 19 turns off electrical discharge switch 18 to maintain electrical discharge switch 18 in an open state. In this case, a potential difference between the ends of first arrester Z1 and first varistor Z2 that are connected in series is 1 KV, and a potential difference between the ends of second arrester Z3 and second varistor Z4 is also 1 KV. Accordingly, first arrester Z1 is in an open state because the applied voltage is equal to or less than the discharge starting voltage, and second arrester Z3 is also in an open state because the applied voltage is equal to or less than the discharge starting voltage.

In contrast, when stopping the power supply, electrical discharge control circuit 19 first turns off anode switch 16 using anode switch control circuit 17 to stop supply of the anode voltage (A) to anode electrode 5. At this time, the anode voltage (A) becomes equal to the helix voltage (HK) as shown in FIG. 4.

Subsequently, electrical discharge control circuit 19 stops operation of inverter 12 to stop output of the helix voltage (HK), the first collector voltage (COL1), and the second collector voltage (COL2). Since electric charges accumulated in rectifier capacitors C1 to C3 are mostly not discharged in this state, as illustrated in FIG. 4, the helix voltage (HK), the first collector voltage (COL1), and the second collector voltage (COL2) decrease slightly towards the potential of the helix (HEL: ground potential).

Next, electrical discharge control circuit 19 turns on electrical discharge switch 18 to start discharge of electric charges that are accumulated in rectifier capacitors C1 to C3.

When electrical discharge switch 18 is turned on, resistor R1 is connected through electrical discharge switch 18 in a short-circuit state to both ends of rectifier capacitor C1 that is connected between cathode electrode 7 and first collector electrode 3. Thereupon, discharge of an electric charge accumulated in rectifier capacitor C1 starts. At this time, the electric charge accumulated in rectifier capacitor C1 is consumed by resistor R1.

Further, when electrical discharge switch 18 is turned on, the potential of connection node a of electrical discharge switch 18 and resistor R1 becomes equal to the helix voltage (HK), and a potential difference between the ends of first arrester Z1 and first varistor Z2 rises to approximately 2 KV so that a voltage exceeding the discharge starting voltage is applied to first arrester Z1. Thus, first arrester Z1 starts electric discharge and enters a short-circuit state. When first arrester Z1 enters a short-circuit state, resistors R1 and R2 are connected through first arrester Z1 that is in a short-circuit state to both ends of rectifier capacitor C2 that is connected between first collector electrode 3 and second collector electrode 4, and the discharge of an electric charge accumulated in rectifier capacitor C2 starts. At this time, the electric charge accumulated in rectifier capacitor C2 is consumed by resistors R1 and R2 that are connected in series.

Furthermore, when first arrester Z1 enters a short-circuit state, the potential of connection node b of first varistor Z2 and resistor R2 becomes equal to the potential of connection node a, and a potential difference at the ends of second arrester Z3 and second varistor Z4 rises to approximately 2 KV so that the voltage that exceeds the discharge starting voltage is applied to second arrester Z3. Thus, second arrester Z3 starts electric discharge and enters a short-circuit state. When second arrester Z3 enters a short-circuit state, resistors R2 and R3 are connected through second arrester Z3 that is in a short-circuit state to both ends of rectifier capacitor C3 that is connected between second collector electrode 4 and helix 2, and discharge of an electric charge accumulated in rectifier capacitor C3 starts. At this time, the electric charge accumulated in rectifier capacitor C3 is consumed by resistors R2 and R3 that are connected in series.

A signal for turning off the heater voltage (H) or a discharge start signal that is supplied from outside or the like may be used as a trigger with respect to the timing at which electrical discharge control circuit 19 turns on electrical discharge switch 18. The term "discharge start signal" refers to a signal for causing discharge of electric charges accumulated in rectifier capacitors C1 to C3 that is input using a switch provided on a case of the power supply apparatus by, for example, a worker who performs maintenance operations or a test.

Electrical discharge switch 18 that is turned on may be turned off after a preset time has elapsed. It is sufficient that a time for maintaining electrical discharge switch 18 in an on state is set to a time in which the helix voltage (HK), the first collector voltage (COL1), and the second collector voltage (COL2) sufficiently decrease. Alternatively, a configuration may be adopted in which, when the power is next turned on, electrical discharge switch 18 is turned off by electrical discharge control circuit 19 prior to actuating inverter 12.

According to the present exemplary embodiment, an example is illustrated in which electrical discharge control circuit 19 controls an on/off state of electrical discharge switch 18 and also controls operations of anode switch control circuit 17 and inverter 12 and the like when stopping the power supply. However, in a case in which power supply apparatus 10 comprises a sequence control circuit, not shown, that controls the overall operations of power supply apparatus 10, the operations of electrical discharge control circuit 19, anode switch control circuit 17, and inverter 12 and the like may be collectively controlled by the sequence control circuit. Electrical discharge control circuit 19 can be implemented by combining an isolation transformer or a driver circuit for driving a switch, a CPU or a DSP that operate according to a program, and various logic circuits. A sequence control circuit can be implemented by combining various logic circuits and a CPU or a DSP that operate according to a program.

According to the power supply apparatus of the present exemplary embodiment, at the time of stopping operation of power supply apparatus 10, turning on electrical discharge switch 19 serves as an impetus for each arrester to start electric discharge and to enter a short-circuit state. By setting the discharge starting voltage of each arrester such that each arrester is maintained in an open state during normal operation when electrical discharge switch 18 is off, when stopping operation of power supply apparatus 10, electric charges accumulated in rectifier capacitors C1 to C3 can be discharged by merely turning on single electrical discharge switch 18.

Further, even in a case in which a collector voltage is supplied to a plurality of collector electrodes, by serially connecting a number of arresters that is equal to the total number of the collector electrodes and electrical discharge switch 18, and by connecting resistors between electrical discharge switch 18 and the arresters, and the collector electrodes and a ground potential, respectively, electric charges that are accumulated in rectifier capacitors can be easily discharged.

Furthermore, since electrical discharge switch 18 and each arrester are in an open state during normal operation and thus a current does not flow to resistors that are serially connected thereto, electric charges that are accumulated in rectifier capacitors C1 to C3 can be discharged using resistors that have a smaller value than a discharge bleeder resistor.

Accordingly, electric charges that are accumulated in rectifier capacitors when the power supply is turned off can be discharged in a shorter time than heretofore using a low cost and simple configuration while ensuring safety when performing work after the power supply is turned off.

Further, by serially connecting a varistor to each arrester, respectively, and causing the varistors to enter an open state to cutoff current (follow current) flowing to the arresters at a stage where a potential difference of approximately several V to several tens of V remains at both ends of the arresters and varistors, an arrester that is in a short-circuit state when stopping operation of the power supply apparatus can be returned to an open state more quickly. It is thus possible to suppress the occurrence of an accident that damages power supply apparatus 10.

Second Exemplary Embodiment

Figure 5:
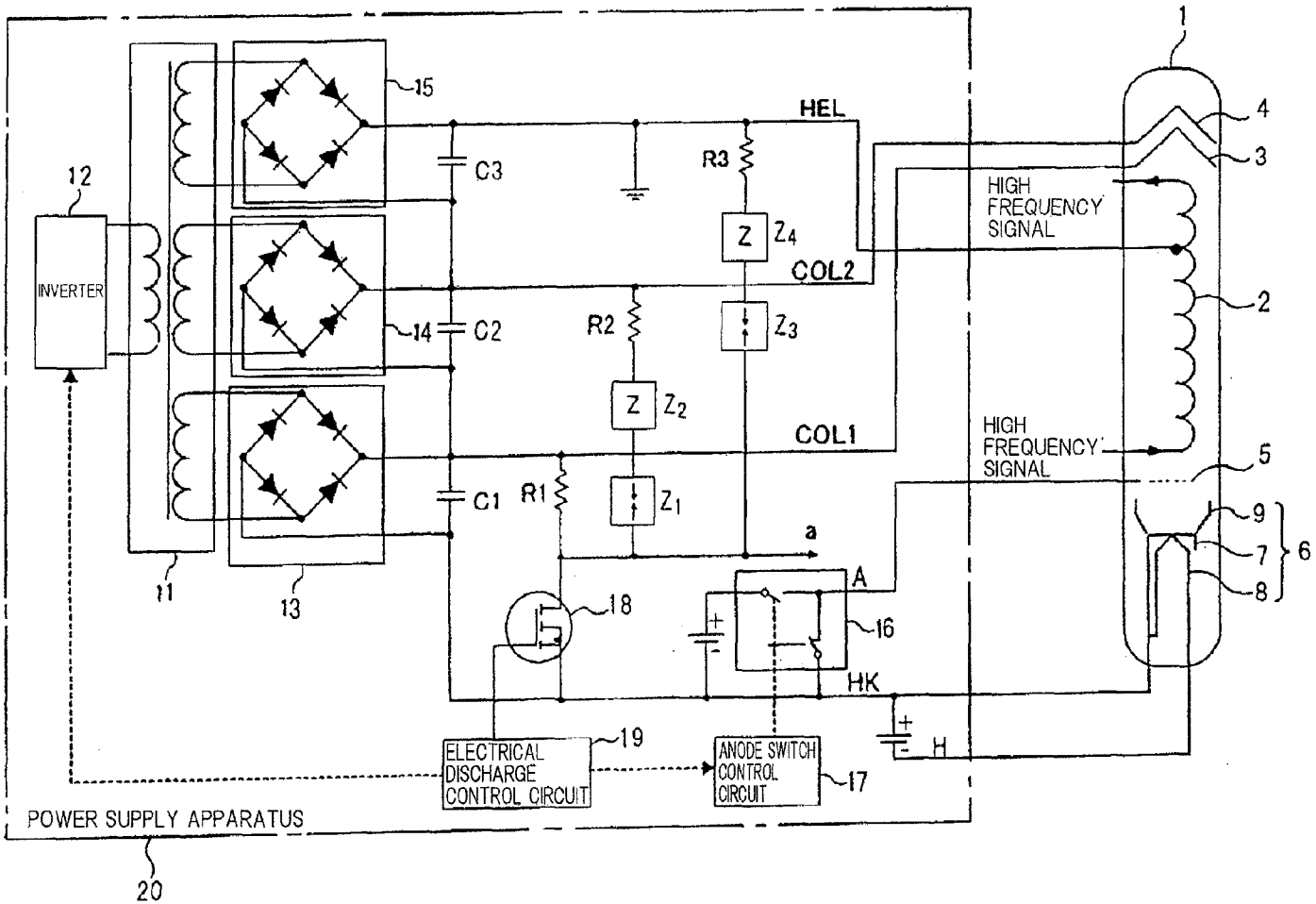
FIG. 5 is a block diagram that illustrates the configuration of a high-frequency circuit system according to a second exemplary embodiment.

FIG. 5 is a block diagram that illustrates the configuration of a high-frequency circuit system according to a second exemplary embodiment.

As shown in FIG. 5, power supply apparatus 20 of the second exemplary embodiment differs from the power supply apparatus of the first exemplary embodiment in the respect that second arrester Z3, second varistor Z4 and resistor R3 that are connected in series are connected between the helix (ground potential) and connection node a of electrical discharge switch 18 and resistor R1.

Similarly to the first exemplary embodiment, the power supply apparatus of the second exemplary embodiment can discharge electric charges accumulated in rectifier capacitors C1 to C3 even without first varistor Z2 and second varistor Z4 shown in FIG. 5. According to the power supply apparatus of the second exemplary embodiment, when traveling-wave tube 1 comprises three or more collector electrodes, it is sufficient that electrical discharge switch 18 and resistor R1 (first resistor) that are serially connected are inserted between cathode electrode 7 and first collector electrode 3, and that N (N denotes a positive integer) arresters and resistors (second resistors) that are serially connected are inserted between connection node a of electrical discharge switch 18 and resistor R1, and the second collector electrode to an Nth (N denotes a positive integer) collector electrode and ground potential, respectively. In this case, when using varistors, it is sufficient to connect respective varistors between each arrester and second resistor. The remaining configuration of the power supply apparatus and configuration of the traveling-wave tube is the same as in the first exemplary embodiment, and a description of these is thus omitted below.

According to the power supply apparatus of the second exemplary embodiment, when stopping the power supply, when electrical discharge control circuit 19 turns on electrical discharge switch 18, similarly to the power supply apparatus according to the first exemplary embodiment, resistor R1 is connected through electrical discharge switch 18 in a short-circuit state to both ends of rectifier capacitor C1 that is connected between cathode electrode 7 and first collector electrode 3, and discharge of the electric charge accumulated in rectifier capacitor C1 starts. At this time, the electric charge accumulated in rectifier capacitor C1 is consumed by resistor R1.

Further, when electrical discharge switch 18 is turned on, the potential of connection node a of electrical discharge switch 18 and resistor R1 becomes equal to the helix voltage (HK) and a potential difference at both ends of first arrester Z1 and first varistor Z2 rises to approximately 2 KV so that a voltage that exceeds the discharge starting voltage is applied to first arrester Z1. Thus, first arrester Z1 starts electric discharge and enters a short-circuit state. When first arrester Z1 enters a short-circuit state, resistors R1 and R2 are connected through first arrester Z1 that is in a short-circuit state to both ends of rectifier capacitor C2 that is connected between first collector electrode 3 and second collector electrode 4, and discharge of an electric charge accumulated in rectifier capacitor C2 starts. At this time, the electric charge accumulated in rectifier capacitor C2 is consumed by resistors R1 and R2 that are connected in series.

Furthermore, when electrical discharge switch 18 is turned on and the potential of connection node a becomes equal to the helix voltage (HK), a potential difference at both ends of second arrester Z3 and second varistor Z4 rises to approximately 3 KV so that a voltage that exceeds the discharge starting voltage is applied to second arrester Z3. Thus, second arrester Z3 starts electric discharge and enters a short-circuit state. When second arrester Z3 enters a short-circuit state, resistors R2 and R3 are connected through second arrester Z4 that is in a short-circuit state to both ends of rectifier capacitor C3 that is connected between second collector electrode 4 and helix 2, and discharge of an electric charge accumulated in rectifier capacitor C3 starts. At this time, the electric charge accumulated in rectifier capacitor C3 is consumed by resistors R2 and R3 that are connected in series. Since the other operations when stopping the power supply and operations during normal operation of the traveling-wave tube are the same as in the first exemplary embodiment, a description thereof is omitted here.

Similarly to the power supply apparatus of the first exemplary embodiment, the power supply apparatus of the second exemplary embodiment is capable of discharging electric charges that are accumulated in rectifier capacitors when the power supply is turned off in a shorter time than heretofore using a low cost and simple configuration while ensuring safety when performing work after the power supply is turned off.

While the invention has been particularly shown and described with reference to exemplary embodiments thereof, the invention is not limited to these embodiments. It will be understood by those ordinarily skilled in the art that various changes in form and details may be made therein without departing from the spirit and scope of the present invention as defined by the claims.

What is claimed is:

1. A power supply apparatus that supplies a predetermined DC voltage to an anode electrode, a cathode electrode and a first collector electrode to an Nth collector electrode of an electron tube, the power supply apparatus comprising, when N is assumed to be a positive integer:

an electrical discharge switch and a first resistor that are serially connected, and that are connected between said cathode electrode and said first collector electrode;

N arresters that are serially connected, and that are inserted between a ground potential and a connection node of said electrical discharge switch and said first resistor;

N second resistors that are inserted between said N arresters and a second collector electrode to the Nth collector electrode and a ground potential, respectively; and an electrical discharge control circuit that turns off said electrical discharge switch at a time of normal operation of said power supply apparatus to put said electrical discharge switch in an open state, and turns on said electrical discharge switch when stopping operation of said power supply apparatus to put said electrical discharge switch in a short-circuit state.

2. The power supply apparatus according to claim 1, further comprising N varistors that are connected between said arresters and said second resistors, and with respect to which an arrester of a next stage is connected to a connection node with said second resistor.

3. The power supply apparatus according to claim 1, further comprising:

an anode switch that supplies or does not supply an anode voltage to said anode electrode; and an anode switch control circuit that turns said anode switch on or off;

wherein, when stopping operation of said power supply apparatus, before stopping a supply of DC voltage to said cathode electrode and said collector electrode and turning on said electrical discharge switch, said electrical discharge control circuit turns off said anode switch using said anode switch control circuit to stop a supply of an anode voltage to said anode electrode.

4. A high-frequency circuit system, comprising:

a power supply apparatus according to claim 1; and a traveling-wave tube to which an anode voltage, a cathode voltage, a collector voltage and a helix voltage that are a predetermined DC voltage are supplied from the power supply apparatus.

5. A power supply apparatus that supplies a predetermined DC voltage to an anode electrode, a cathode electrode and a first collector electrode to an Nth collector electrode of an electron tube, wherein the power supply apparatus comprises, when N is assumed to be a positive integer:

an electrical discharge switch and a first resistor that are serially connected, and that are connected between said cathode electrode and said first collector electrode;

N arresters and N second resistors that are serially connected, and that are inserted between a connection node of said electrical discharge switch and said first resistor, and a second collector electrode to an Nth collector electrode and a ground potential, respectively; and an electrical discharge control circuit that turns off said electrical discharge switch at a time of normal operation of said power supply apparatus to put said electrical discharge switch in an open state, and turns on said electrical discharge switch when stopping operation of said power supply apparatus to put said electrical discharge switch in a short-circuit state.

6. The power supply apparatus according to claim 5, further comprising N varistors that are connected between said arresters and said second resistors.

7. The power supply apparatus according to claim 5, further comprising:

an anode switch that supplies or does not supply an anode voltage to said anode electrode; and an anode switch control circuit that turns said anode switch on or off;

wherein, when stopping operation of said power supply apparatus, before stopping a supply of DC voltage to said cathode electrode and said collector electrode and turning on said electrical discharge switch, said electrical discharge control circuit turns off said anode switch using said anode switch control circuit to stop a supply of an anode voltage to said anode electrode.

8. A high-frequency circuit system, comprising:

a power supply apparatus according to claim 5; and a traveling-wave tube to which an anode voltage, a cathode voltage, a collector voltage and a helix voltage that are a predetermined DC voltage are supplied from the power supply apparatus.

9. A power supply apparatus that supplies a predetermined DC voltage to an anode electrode, a cathode electrode and a collector electrode of an electron tube, the power supply apparatus comprising:

an electrical discharge switch and a first resistor that are serially connected, and that are connected between said cathode electrode and said collector electrode;

an arrester and a second resistor that are serially connected, and that are inserted between a ground potential and a connection node of said electrical discharge switch and said first resistor; and an electrical discharge control circuit that turns off said electrical discharge switch at a time of normal operation of said power supply apparatus to put said electrical discharge switch in an open state, and turns on said electrical discharge switch when stopping operation of said power supply apparatus to put said electrical discharge switch in a short-circuit state.

10. The power supply apparatus according to claim 9, further comprising a varistor that is serially connected between said arrester and said second resistor.

11. The power supply apparatus according to claim 9, further comprising:

an anode switch that supplies or does not supply an anode voltage to said anode electrode; and an anode switch control circuit that turns said anode switch on or off;

wherein, when stopping operation of said power supply apparatus, before stopping a supply of DC voltage to said cathode electrode and said collector electrode and turning on said electrical discharge switch, said electrical discharge control circuit turns off said anode switch using said anode switch control circuit to stop a supply of an anode voltage to said anode electrode.

12. A high-frequency circuit system, comprising:

a power supply apparatus according to claim 9; and a traveling-wave tube to which an anode voltage, a cathode voltage, a collector voltage and a helix voltage that are a predetermined DC voltage are supplied from the power supply apparatus.

* * * * *